United States Patent [19]

Lagasse

[11] 4,341,267

[45] Jul. 27, 1982

[54] CHIMNEY FIRE EXTINGUISHER

[76] Inventor: Guy Lagasse, 94 Bush Hill Rd., Manchester, Conn. 06040

[21] Appl. No.: 167,385

[22] Filed: Jul. 9, 1980

[51] Int. Cl.[3] ..... A62C 37/00

[52] U.S. Cl. ..... 169/54; 169/51; 248/311.2

[58] Field of Search ..... 169/51, 52, 54, 57, 169/30, 56, 66, 68; 215/100.5; 248/311.2, 215

[56] References Cited

U.S. PATENT DOCUMENTS

| | | | |
|---|---|---|---|
| 883,149 | 3/1908 | Shafer | 169/54 |
| 1,485,754 | 3/1924 | Albini | 169/54 |
| 2,011,803 | 8/1935 | Dude | 169/54 |
| 2,024,316 | 12/1935 | Theissing | 169/54 |
| 2,297,808 | 10/1942 | Soucy | 169/57 |
| 2,351,365 | 6/1944 | Piagneri | 169/54 |
| 2,673,057 | 3/1954 | Morris, Sr. | 248/311.2 |
| 2,706,527 | 4/1955 | Guljas et al. | 169/68 |
| 3,008,679 | 11/1961 | Powell | 248/311.2 |
| 3,698,675 | 10/1972 | Lerew et al. | 248/311.2 |
| 4,013,127 | 3/1977 | Tenney et al. | 169/57 |

*Primary Examiner*—Robert J. Spar
*Assistant Examiner*—Kenneth Noland

[57] ABSTRACT

A chimney fire extinguisher includes a bracket assembly by which a container of fire-extinguishing fluid is mounted outside the chimney. One leg of a U-shaped member included in the bracket assembly abuts the inner wall of the chimney, while a bracket plate adjustably attached to the web portion abuts the outer wall of the chimney. By adjusting the spacing between the bracket plate and the U-shaped member, it is possible for the assembly to accommodate chimneys of different thicknesses.

4 Claims, 4 Drawing Figures

CHIMNEY FIRE EXTINGUISHER

BACKGROUND OF THE INVENTION

The present invention relates to fire-extinguishing devices for chimneys, particularly those that are to be incorporated in existing chimneys not originally built with fire-extinguishing equipment.

A major source of house fires is the combustion of flammable materials that have collected in chimneys. Although chimney fires have always occurred, the risk of such fires tended to decrease with the trend away from coal and wood to oil and natural gas. Accordingly, concern with cleaning chimneys has declined over the years. In very recent times, though, renewed use of, for instance, wood stoves and fire places has increased the buildup of flammable products in chimneys, sometimes without a corresponding increase in concern for cleaning the chimneys. It would thus be desirable that chimneys built during times when concern about chimney fires was rather low now be adapted to reduce the possibility of damage from such fires.

A number of chimney constructions exist in the prior art that provide for extinguishing fires that have started in the chimneys. An early example is illustrated in Shafer U.S. Pat. No. 883,149, and subsequent examples are illustrated in Albini U.S. Pat. No. 1,485,754, Dube U.S. Pat. No. 2,011,803, Theissing U.S. Pat. No. 2,024,316, Soucy U.S. Pat. No. 2,297,808, and Piagneri U.S. Pat. No. 2,351,365. Despite the number and variety of such constructions, it is thought that most are not particularly applicable to protecting existing chimneys. Some, such as Shafer and Albini, would clearly affect the draft in the chimney. Others, such as Soucy and Piagneri, require that electrical systems be wired into them. Dube exemplifies a type that would require significant custom construction work on the chimney, and others, such as Theissing, would be applicable to outdoor systems in only the most temperate of climates.

It is accordingly the object of the present invention to enable the user to readily fit an existing chimney with fire-extinguishing apparatus. It is another object that this result be achieved while keeping the amount of work expended in retrofitting and custom adaptation to a minimum. A further object is to avoid significantly affecting the draw through the chimney.

SUMMARY OF THE INVENTION

The foregoing and related objects are achieved in a chimney fire extinguisher that includes a fluid container containing a fire-extinguishing fluid and bracket means having a first portion dimensioned and configured to seat upon the cap of an associated chimney. The bracket means has a second portion engaged with the container and adapted to suspend the container outside the associated chimney. The fire extinguisher also includes conduit means having one end communicating with the interior of the fluid container, its other end being spaced from the container for positioning inside the associated chimney and adjacent the first portion of the bracket means when the bracket means seats upon the associated chimney cap and the container is suspended by the bracket means outside the associated chimney. The conduit means includes flow-control means preventing flow through the other end of the conduit means in its normal state and permitting flow in a second state. The flow-control means includes fusible means maintaining the flow-control means in the normal state, but the fusible means is fusible at a predetermined temperature above the normal expected interior temperature of the associated chimney adjacent its cap to cause the flow-control means to assume the second state and thereby permit the fire-extinguishing fluid to flow through the other end of the conduit and quench a fire in the chimney causing the high temperature when the chimney fire extinguisher is mounted by the bracket on the cap in the chimney.

The bracket means typically provides generally opposed first and second clamping surfaces adapted for abutting the interior and exterior surfaces, respectively, of the associated chimney at its cap, and it is preferably adjustable to vary the spacing between the clamp surfaces to accommodate chimney walls of different thicknesses.

In the preferred embodiment, the bracket means includes a unitary generally U-shaped member having first and second leg portions and a web portion extending between them. The first leg portion provides the first clamping surface. The bracket means further includes support means supporting the container on the second leg portion of the U-shaped member and a plate member providing the second clamp surface. The plate member is disposed between the legs, extends generally parallel to them, and is adjustably mounted on the web portion of the U-shaped member for varying the spacing between the plate member and the first leg portion and thereby between the clamp surfaces. The plate member is also adjustably mounted on the second leg portion of the U-shaped member at its free end for adjustment of the spacing between the plate member and the first leg portion.

The bracket means may also include finger means disposed between the plate member and the first leg, extending generally parallel thereto, and adjustably mounted on the U-shaped member to permit adjustment in the spacing between the finger means and the first leg. The finger means would be dimensioned for cooperation with said first leg to clamp between them a flue pipe protruding from the cap of the associated chimney as the plate member abuts the exterior wall of the associated chimney.

The conduit means typically has an outlet orifice at its other end, and the flow-control includes a plug normally held in the orifice by the fusible means to prevent flow through the orifice. Fusing of the fusible means permits the plug to be ejected from the orifice and permits flow through it.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 2:
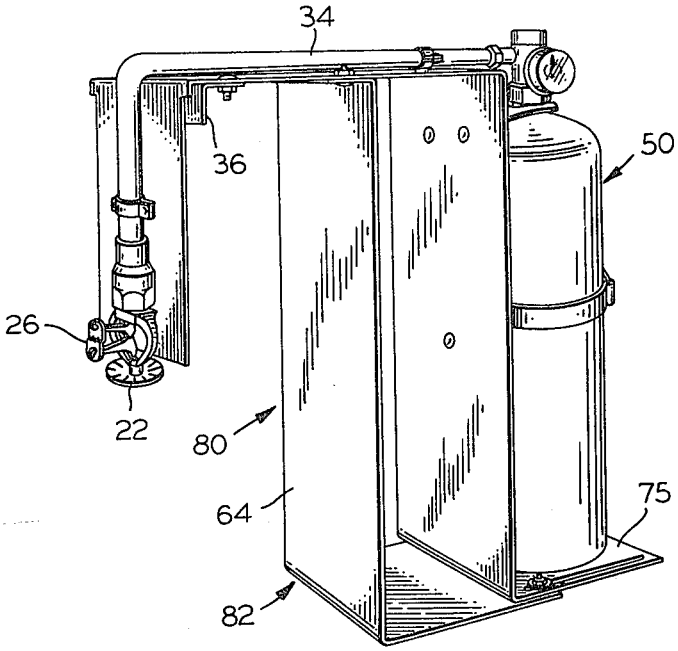
FIG. 2 is a perspective view of the fire-extinguishing device prior to mounting on the chimney.

The drawings illustrate a fire-extinguishing device in which a container 50 holding the fire-extinguishing fluid is mounted by a bracket assembly 80 on the cap 12 of a chimney 84. A conduit 34 provides communication between the interior of container 50 and the interior of chimney 84. When a chimney fire occurs, the heat at the chimney cap is high enough that a fusible link 26 melts and permits a plug 28 to be ejected from the exit orifice of the conduit, thereby causing the fire-extinguishing liquid to be sprayed in the chimney interior.

Figure 1:
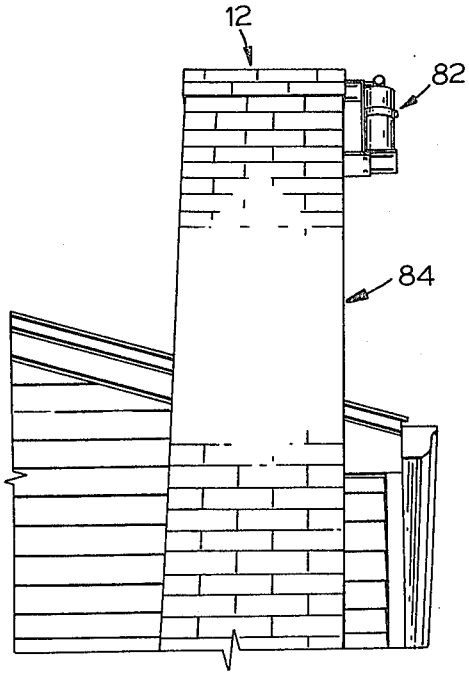
FIG. 1 is a perspective view of a chimney fitted with the fire-extinguishing device of the present invention.

FIG. 1 illustrates a conventional chimney 84 having a chimney cap 12 upon which the apparatus 82 shown in perspective in FIG. 2 is seated. It will be apparent as the description progresses that an existing chimney can readily be fitted with the apparatus 82 by expending little effort in excess of that required to gain access to the cap of the chimney.

Fire-extinguishing apparatus 82 will be described by simultaneous reference to FIGS. 2, 3, and 4. These drawings illustrate that a conventional container 50 for containing the fire-extinguishing fluid and, in some instances, the chemicals for generating the fluid is provided with an L-shaped fluid conduit 34 that communicates with the container 50 at its right end and terminates in a fitting 30 having an orifice, not shown, that is plugged by an upper arm 28 of a plug assembly. The plug assembly is of conventional construction, including lower and upper arms 24 and 28, respectively, and a fusible link 26 that holds the outer ends of the arms in relative proximity. The right ends of arms 24 and 28 engage each other for relative pivotal movement. In the position shown in FIG. 3, arms 24 and 28 are urged by link 26 to press outward against fitting 30 and a portion depending from it that includes a deflection plate 22. By virtue of this pivotal arrangement, upper arm 28 is kept seated in the orifice against the pressure of the fire-extinguishing fluid in conduit 34. Link 26 is made of a metal with a low melting point so that it melts at a temperature that is symptomatic of fire in the chimney. Upon melting, the inward force on the left ends of the arms is released. This releases the outward force on the right ends, and the pressure of the fluid in conduit 38 is thus allowed to eject plug-assembly arm 28 from the orifice and permit the flow of fire-extinguishing fluid through conduit 34. A conventional cap 48 is provided on container 50, and access for recharging is afforded by its removal.

According to the present invention, the container 50 is readily mounted on chimneys of various constructions by being provided with a bracket assembly that includes a generally U-shaped member including left and right leg portions 20 and 56 joined by a horizontal web portion 42. The lower end of right leg 56 provides a horizontal shelf that supports container 50. A yoke member 62 is fastened about the neck of container 50 and has a vertically extending extension by which rivets 54 and 58 attach it to right leg 56 of the U-shaped member. Container 50 is further secured to the extension of yoke member 62 by a conventional releasable strap 58 that can be tightened and loosened by lever 76. Further connections to the U-shaped member may be provided by appropriate brackets such as brackets 32 and 46, which are employed to hold conduit 34 in place on the U-shaped member. Thus, all connections of container 50 and conduit 34 are made to the U-shaped member.

The bracket assembly also includes a bracket plate 64 and an optional finger member 36. An upper flange portion of bracket plate 64 provides a surface for connection to web portion 42 of the U-shaped member. As FIG. 4 shows, web portion 42 is provided with two longitudinally extending slots 68 and 70 through which appropriate fastening means 44, shown here as a bolt, nut, and washer, extend. FIG. 4 also shows that the shelf 75 provided by the U-shaped member has similar slots 74 and 78. A lower horizontal portion of bracket plate 64 is fastened to shelf 75 by appropriate fasteners 53 extending through the slots. It is apparent from this construction that the relative position of bracket plate 64 and left leg 20 can be adjusted by loosening fastening means 44 and 53, moving bracket plate 64 as phantom 60 suggests, and tightening them again when the desired spacing is achieved.

Figure 3:
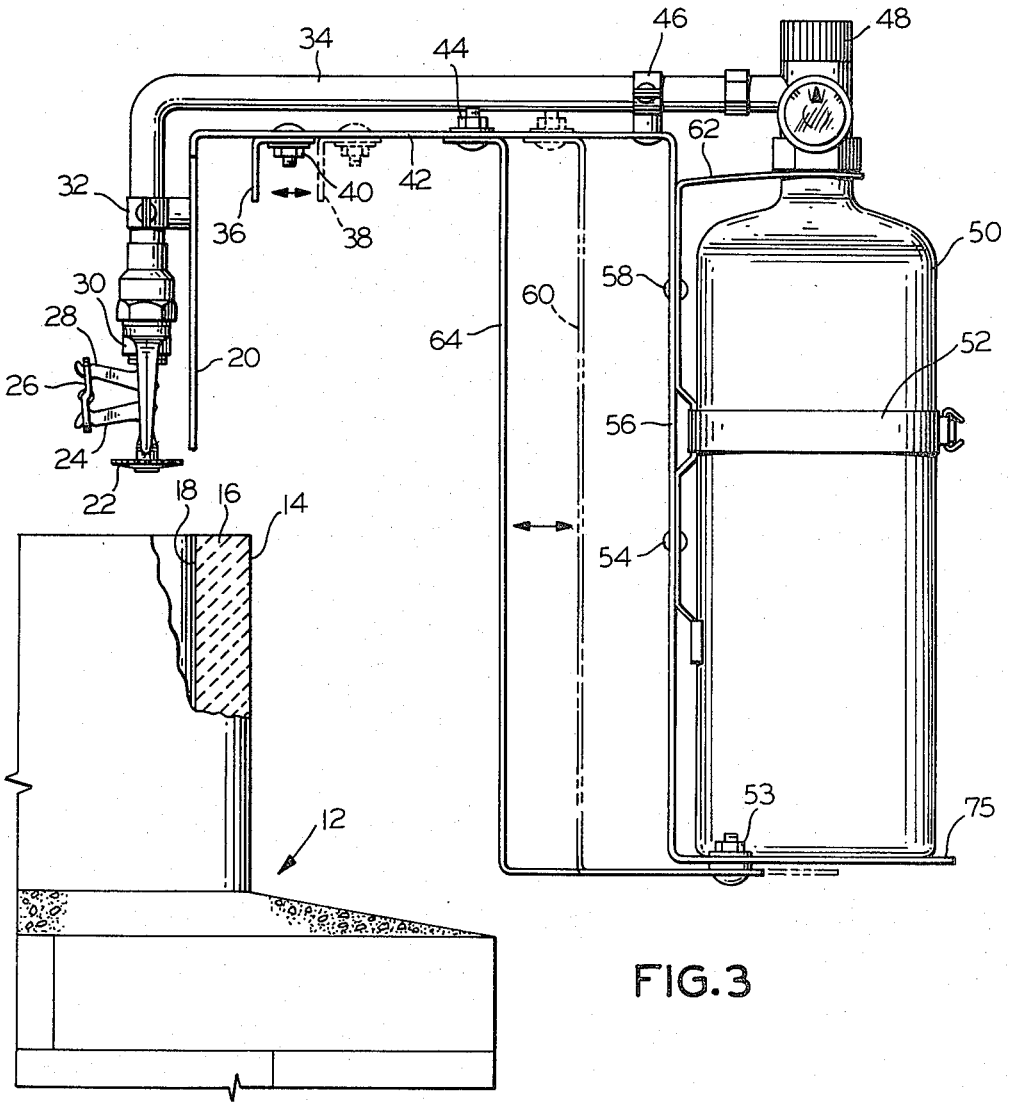
FIG. 3 is an elevational view of the fire-extinguishing device and an associated chimney with the chimney partially broken away.

FIG. 3 shows a portion of chimney cap 12, which has an interior flue pipe 16 that provides the inner wall 18 of the chimney and the outer wall 14 of the flue pipe. The major portion of the chimney outer wall 10 is provided by the masonry surrounding flue pipe 16. The apparatus of the present invention is easily installed on chimneys of various sizes by taking advantage of the adjustability of the bracket assembly. As FIG. 3 shows, the spacing between the bracket plate 64 and the left leg 20 of the U-shaped member is approximately equal to the spacing between inner and outer walls 18 and 10, respectively, of the chimney. Accordingly, the bracket assembly as seen in FIG. 3 is properly adjusted for mounting on the chimney, and the inner surfaces of leg 20 and plate 64 will act as clamping surfaces that abut the chimney's interior and exterior wall surfaces.

FIG. 3 shows flue pipe 16 protruding from the masonry portion of chimney 84. In order to provide greater stability on chimneys of this type, it may be found desirable to provide finger member 36 that depends from web portion 42 of the U-shaped member at a position between bracket plate 64 and left leg portion 20. Fasteners 40 extend through slots 68 and 70 in web portion 42 to adjustably fasten finger 36 in place. It will be appreciated that the spacing between finger 36 and leg portion 20 is approximately equal to the thickness of flue pipe 16, and leg portion 20 and finger 36 can thus cooperate to clamp flue pipe 16 between them. As phantom 38 suggests, finger 36 could easily be adjusted to accommodate flue pipes of different thicknesses.

Figure 4:
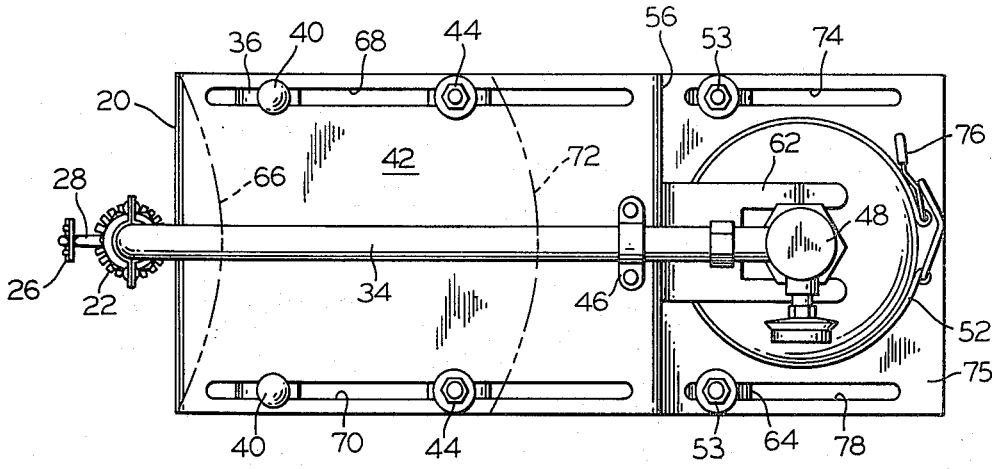
FIG. 4 is a plan view of the fire-extinguishing device.

FIG. 4 includes phantom lines 66 and 72. These phantom lines represent alternate arrangements of left leg portion 20 and bracket plate 64. Although the apparatus illustrated in the drawings is suited for a wide range of generally rectangular chimney caps, it may be found desirable when morecircular chimney structures are encountered to modify the shape of the bracket assembly somewhat. Phantom lines 66 and 72 show that leg 20 and plate 64 could be made arcuate to better accommodate such chimneys.

It is apparent from the foregoing description that the fire-extinguishing apparatus of the present invention provides numerous advantages over the prior art. A single adjustable construction allows the apparatus to be mounted on chimneys of a wide variety of sizes with little or no modification of the chimneys. Furthermore, the construction is such that chimneys with protruding flue pipes are easily accommodated. Finally, the bulk of the apparatus is held out of the normal combustion-gas path, so the chimney "draw" is not adversely affected.

Having thus described the invention, I claim:

1. A chimney fire extinguisher comprising:

a. a container containing fireextinguishing material;

b. bracket means having a first portion dimensioned and configured to seat upon the cap of an associated chimney, said bracket means having a second portion engaged with said container and being adapted to suspend said container outside the associated chimney, said bracket means including a unitary generally U-shaped member having first and second leg portions and a web portion extending therebetween, said first leg portion providing a first clamp surface adapted for abutting the interior surface of the associated chimney at its cap, said bracket means further including support means supporting said container on said second leg portion of said U-shaped member and a plate member providing a second clamp surface adapted for abutting the interior surface of the associated chimney at its cap, said plate member being disposed between said legs, extending generally parallel thereto, and being adjustably mounted on said web portion of said U-shaped member for varying the spacing between said plate member and said first leg portion and thereby between said clamp surfaces to accommodate chimney walls of different thicknesses;

c. conduit means having one end communicating with the interior of said fluid container, the other end of said conduit means being spaced from said container for positioning inside the associated chimney and adjacent said first portion of said bracket means when said bracket means seats upon the associated chimney cap and said container is suspended by said bracket means outside the associated chimney, said conduit means including flow-control means preventing flow through said conduit means in its normal state and permitting flow through said conduit means in a second state, said flow-control means including fusible means maintaining said flow-control means in said normal state but being fusible at a predetermined temperature above the normal expected interior temperature of the associated chimney adjacent its cap to cause said flow-control means to assume said second state and thereby permit said fire-extinguishing material to flow through said conduit and quench a fire in the chimney causing the high temperature when said chimney fire extinguisher is mounted by said bracket on the cap of the chimney.

2. The chimney fire extinguisher of claim 1 wherein said plate member is also adjustably mounted on said second leg portion of said U-shaped member at the free end thereof for adjustment of the spacing between said plate member and said first leg portion.

3. The chimney fire extinguisher of claim 1 wherein said bracket means further includes finger means disposed between said plate member and said first leg, extending generally parallel thereto, and adjustably mounted on said U-shaped member to permit adjustment in the spacing between said finger means and said first leg, said finger means being dimensioned for cooperation with said first leg to clamp therebetween a flue pipe protruding from the cap of the associated chimney as said plate member abuts the exterior wall of the associated chimney.

4. The chimney fire extinguisher of claim 1 wherein said conduit means has an outlet orifice at said other end thereof and said flow-control means includes a plug normally held in said orifice by said fusible means to prevent flow through said orifice, fusing of said fusible means permitting said plug to be ejected from said orifice and permit flow therethrough.

* * * * *